US010028565B2

(12) United States Patent
Hasegawa

(10) Patent No.: US 10,028,565 B2
(45) Date of Patent: Jul. 24, 2018

(54) COSMETIC CONTAINER

(71) Applicant: AMG Co., Ltd., Tokyo (JP)

(72) Inventor: Hiroki Hasegawa, Tokyo (JP)

(73) Assignee: AMG Co., Ltd., Tokyo (JP)

( * ) Notice: Subject to any disclaimer, the term of this patent is extended or adjusted under 35 U.S.C. 154(b) by 221 days.

(21) Appl. No.: 15/118,840

(22) PCT Filed: Feb. 26, 2016

(86) PCT No.: PCT/JP2016/001062

§ 371 (c)(1),
(2) Date: Aug. 12, 2016

(87) PCT Pub. No.: WO2017/145200

PCT Pub. Date: Aug. 31, 2017

(65) Prior Publication Data

US 2018/0064230 A1 Mar. 8, 2018

(51) Int. Cl.
*A46B 11/00* (2006.01)
*A45D 34/04* (2006.01)

(52) U.S. Cl.
CPC ..... *A45D 34/045* (2013.01)

(58) Field of Classification Search
CPC ..... A45D 34/045
USPC ..... 401/127
See application file for complete search history.

(56) References Cited

U.S. PATENT DOCUMENTS 3,246,657 A * 4/1966 Roller, Sr. ..... A45D 34/04 132/317
2003/0235454 A1 12/2003 Gueret
2005/0196219 A1* 9/2005 Habatjou ..... A46B 5/005 401/127

(Continued)

FOREIGN PATENT DOCUMENTS

JP 2003-235640 A 8/2003
JP 2005-125021 B1 5/2005

(Continued)

OTHER PUBLICATIONS

International Search Report and Written Opinion of the International Searching Authority for related International pplication No. PCT/JP2016/001062 in 4 pages.

*Primary Examiner* — Huyen Le
(74) *Attorney, Agent, or Firm* — Procopio Cory Hargreaves and Savitch LLP; Pattric Rawlins

(57) ABSTRACT

Provided is a cosmetic container that can be used in a process of grasping the cosmetic container, a process of taking out an applicator from the container, and a process of storing the applicator therein. The cosmetic container can be held by one hand of the user, and includes a first container that has an applicator provided therein and has a substantially circular cross-section in a direction perpendicular to a length direction, and a second container that removably engages with the first container, is longer than the first container, has a substantially circular cross-section in a direction perpendicular to a length direction, and has an application material stored therein, in which a profile of the cosmetic container formed when the first container and the second container engage with each other is substantially spindle shaped, and the a lengths and diameters of the first and second containers fall within predetermined values.

2 Claims, 5 Drawing Sheets

(56) References Cited

U.S. PATENT DOCUMENTS

| | | | | |
|---|---|---|---|---|
| 2010/0003065 | A1 | 1/2010 | Haan | |
| 2012/0093566 | A1* | 4/2012 | Gueret | A45D 34/046<br>401/122 |
| 2012/0312315 | A1* | 12/2012 | Gueret | A45D 34/045<br>132/200 |
| 2013/0129399 | A1* | 5/2013 | Limongi | A45D 40/267<br>401/16 |

FOREIGN PATENT DOCUMENTS

| | | | |
|---|---|---|---|
| JP | 2010-12223 | A | 1/2010 |
| JP | 2012-526594 | A | 11/2012 |
| JP | 2013-158488 | A | 8/2013 |

* cited by examiner

COSMETIC CONTAINER

FIELD

The present invention relates to a cosmetic container.

BACKGROUND

In a cosmetic container for cosmetic substance application, it is important that a user can handle the container to apply a cosmetic substance such as mascara effectively and comfortably.

For example, Patent Literature 1 proposes an application container that has a favorable appearance and that provides easy application even when an application target portion is a surface or the like.

CITATION LIST

Patent Literature

Patent Literature 1: Japanese Unexamined Patent Application Publication No. 2008-67959

SUMMARY

Technical Problem

When using a cosmetic container for application, a user needs to perform a series of operations including grasping the container (step 1), taking out an applicator from the container (step 2), putting a cosmetic substance on the applicator (step 3), applying the cosmetic substance to the face or the like (step 4), and storing the applicator in the container after the application (step 5). The conventional technique proposes improvements of steps 3 and 4; however, problems related to steps 1, 2, and 5 have not been sufficiently solved.

The present invention has been achieved in view of the above problems, and an object of the present invention is to provide a cosmetic container that can be used by a user effectively and comfortably in a process of grasping a cosmetic container for application, a process of taking out an applicator from the container, and a process of storing the applicator therein.

Solution to Problem

A first invention is a cosmetic container that can be held by one hand of a user and comprises: a first container that has an applicator provided therein and has a cross-section in a direction perpendicular to a length direction, the cross-section being formed in a substantially circular shape; and a second container that removably engages with the first container, is longer than the first container, has a cross-section in a direction perpendicular to a length direction, the cross-section being formed in a substantially circular shape, and has an application material stored therein, wherein a profile of the cosmetic container formed when the first container and the second container engage with each other is substantially spindle-shaped, the first container is formed to have a length accounting for not less than 30% and not more than 45% of a length of the cosmetic container and the second container is formed to have a length accounting for not less than 55% and not more than 70% thereof, assuming that a middle position in a length direction of the cosmetic container is a first middle position, middle positions in a length between the first middle position and closed ends of the cosmetic container are second middle positions, and middle positions in a length between the second middle positions and the closed ends are third middle positions, a diameter $\phi 2$ at the first middle position is a maximum diameter of the cosmetic container, a ratio $\phi 3/\phi 2$ of a diameter $\phi 3$ at the second middle positions to the diameter $\phi 2$ is not less than 0.85 and not more than 0.90, and a ratio $\phi 4/\phi 2$ of a diameter $\phi 4$ at the third middle positions to the diameter $\phi 2$ is not less than 0.52 and not more than 0.56, and a ratio $\phi 5/\phi 2$ of a diameter $\phi 5$ at a position where an open end of the first container and an open end of the second container are in contact with each other to the diameter $\phi 2$ is not less than 0.94 and not more than 0.98.

The inventors of the present invention studied a relation in a cosmetic container that is generally rod-shaped and that can be held by one hand between motions of human palms and fingers and the structure of the cosmetic container during handling of the cosmetic container. As a result of trial and error, the inventors found that the configuration of the first invention enabled the user to use the cosmetic container effectively and comfortably in a process of grasping the cosmetic container, a process of taking out the applicator from the container, and a process of storing the applicator in the container.

A second invention is the cosmetic container with the configuration of the first invention, wherein each of the first container and the second container has an internal member and an external member formed in substantially symmetrical shapes, the external members are formed of a transparent material, and a wall thickness of a major part of the external members is not less than 8% and not more than 9.5% of the diameter $\phi 2$.

The inventors of the present invention studied a relation between a force applied by the user with the fingers when the user grasps the cosmetic container and a visual effect provided by the cosmetic container to the user, and found that a slightly larger force was applied with the fingers in a case where the external members were transparent than in a case where the external members were opaque, and that this was suitable for handling the cosmetic container. This is attributed to the fact that the transparent external members make the user more conscious of the internal members than the external members. The inventors found that, in the rod-like cosmetic container that can be held by one hand, a force suitable for handling the cosmetic container was applied when the thickness of a major part of the wall of the external member is not less than 8% of the maximum diameter $\phi 2$ of the cosmetic container and not more than 9.5% thereof. Application of a suitable force with the fingers enables the first container and the second container to be engaged or disengaged effectively and comfortably.

A third invention is the cosmetic container with the configuration of the second invention, wherein the first container and the second container are formed to engage with each other with an external thread of one of the containers and an internal thread of the other container being screwed with each other, a circular rib is formed on an outer periphery near an open end of each of the internal members, a circular concave groove is formed on an inner periphery near an open end of each of the external members, at least one concave portion is formed on the rib, a projection as many as the concave portion is formed on the concave groove, engagement between the rib and the concave groove prevents displacement of the internal member and the external member in the length direction of the cosmetic container, and engagement between the concave portion and the projection prevents the internal member and the external member from relatively turning.

According to the configuration of the third invention, a configuration that engages the internal member and the external member with each other is provided near the open end, and the user can visually recognize the configuration because the external member is transparent. When the user performs an operation to engage or disengage the first container and the second container, it is desirable that the user applies a force to a position near the open end. According to the configuration of the present invention, the configuration that engages the internal member and the external member with each other serves as a mark indicating the position near the open end, which enables the user to promptly apply a force to an appropriate portion.

Advantageous Effects of Invention

With the cosmetic container according to the present invention, the user can use the cosmetic container effectively and comfortably in the process of grasping the cosmetic container, the process of taking out the applicator from the container, and the process of storing the applicator in the container.

DESCRIPTION OF EMBODIMENTS

Exemplary embodiments of the present invention will be explained below with reference to the accompanying drawings.

Figure 1:
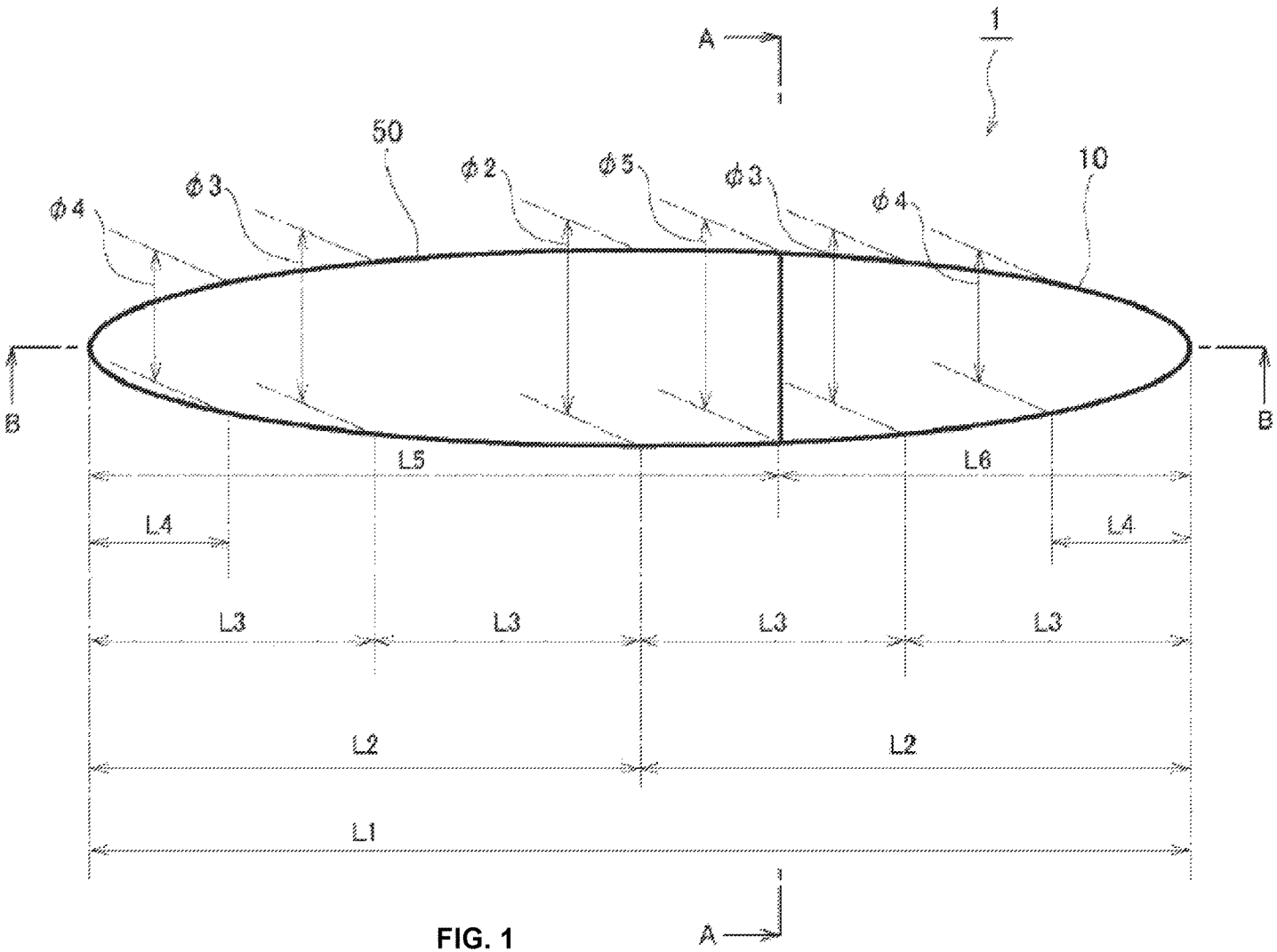
FIG. 1 is a schematic general view of a cosmetic container according to a first embodiment of the present invention.
Figure 2:
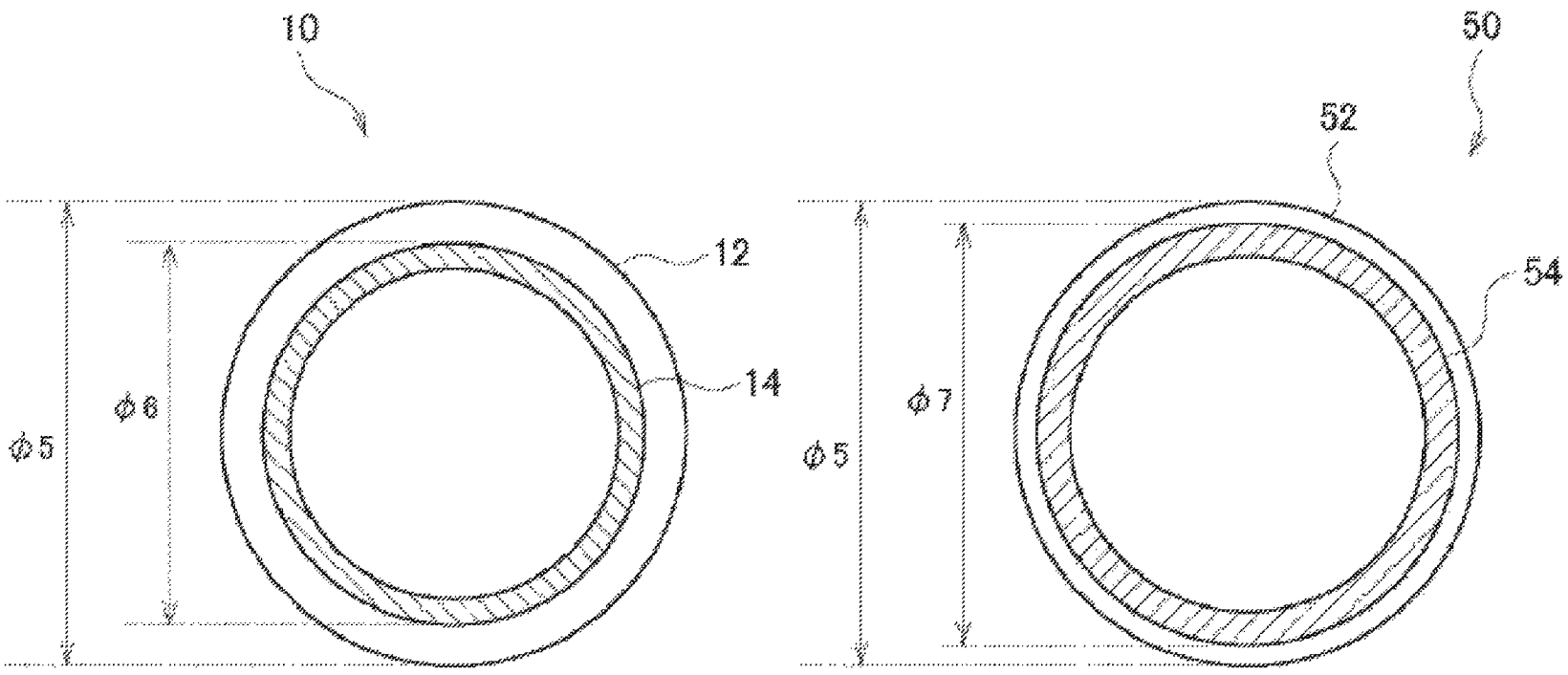
FIG. 2 is a schematic view illustrating end faces of a first container and a second container at open ends.
Figure 3:
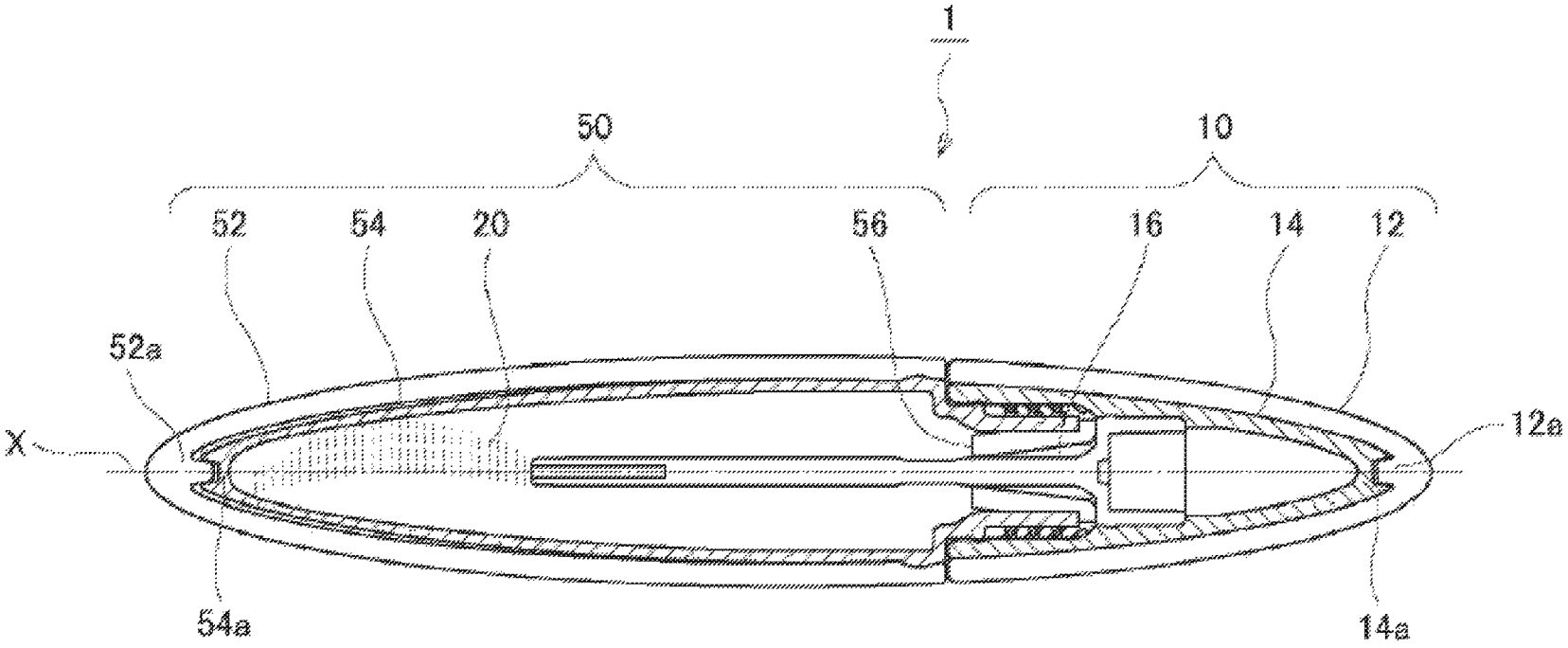
FIG. 3 is a schematic general view illustrating inside of the cosmetic container according to the first embodiment.

As illustrated in FIGS. 1 and 3, a cosmetic container 1 includes a first container 10 and a second container 50 and is formed in a symmetrical spindle shape. The cosmetic container 1 is substantially circular in section in a direction perpendicular to the length direction (the direction of an X axis in FIG. 3). That is, as illustrated in FIG. 2, cross-sectional shapes of the first container 10 and the second container 50 in the direction perpendicular to the length direction are substantially circular. The second container 50 is longer than the first container 10 and has an application material (cosmetic substance) stored therein. The application material is mascara, for example. The cosmetic container 1 has a size that can be held by one hand and is portable. The first container 10 and the second container 50 are configured to removably engage with each other with an external thread and an internal thread. When the first container 10 and the second container 50 are to be engaged with each other or disengaged to be detached from each other, the second container 50 is held with four fingers of the left hand except for the pinky and the first container 10 is turned with the thumb, the index finger, and the middle finger of the right hand, for example.

As illustrated in FIG. 3, the first container 10 includes an external member 12 and an internal member 14. A brush stick 16 is provided to the internal member 14 and a brush 20 serving as an applicator is placed at a distal end of the brush stick 16.

The second container 50 includes an external member 52 and an internal member 54 and has mascara (not illustrated) stored in the internal member 54. A packing 56 is placed near an open end of the internal member 54 to control mascara adhering to the brush 20 to an appropriate amount. When the brush 20 passes through the packing 56, excessive mascara gets dropped into the internal member 54 so that the appropriate amount of mascara remains on the brush 20.

The members of the cosmetic container 1 are formed of resins. The external member 12 and the external member 52 are formed by injection molding of a resin material having a high transparency, for example, polyethylene terephthalate (PET). The internal member 14 is formed by injection molding of acrylonitrile butadiene styrene (ABS), for example. The internal member 54 is formed by injection molding of polypropylene (PP), for example. The internal member 14 and the internal member 54 are opaque and are colored with a shiny color, for example. The internal member 14 and the internal member 54 can be visually recognized through the external member 12 and the external member 52.

The internal thread is formed near the open end of the first container 10 and is screwed with the external thread of the second container 20. Screwing of these threads enables the first container 10 and the second container 20 to be removably engaged with each other.

In the present embodiment, an entire length L1 (see FIG. 1) of the cosmetic container 1 is 115.2 mm (millimeters). A length L6 of the first container 10 is preferably not less than 30% and not more than 45% of the length L1 and is 43.2 mm in the present embodiment. A length L5 of the second container 50 is preferably not less than 55% and less than 70% of the length L1 and is 72 mm in the present embodiment.

As illustrated in FIG. 1, a length L2 is 50% of the length L1, a length L3 is 50% of the length L2, and a length L4 is 50% of the length L3. A position at the length L2 from either end of the cosmetic container 1 is a first middle position, positions at the length L3 therefrom are second middle positions, and positions at the length L4 therefrom are third middle positions. A diameter $\phi 2$ at the first middle position is the maximum diameter of the cosmetic container 1 and the diameter decreases toward the ends of the cosmetic container 1. A ratio $\phi 3/\phi 2$ of a diameter $\phi 3$ at the second middle position to the diameter $\phi 2$ is preferably not less than 0.85 and not more than 0.90. In the present embodiment, the diameter $\phi 3$ is 18.1 mm, the diameter $\phi 2$ is 20.7 mm, and the ratio $\phi 3/\phi 2$ is 0.87. A ratio $\phi 4/\phi 2$ of a diameter $\phi 4$ at the third middle position to the diameter $\phi 2$ is preferably not less than 0.52 and not more than 0.56. The diameter $\phi 4$ in the present embodiment is 11.2 mm and the ratio $\phi 4/\phi 2$ is 0.54.

A ratio $\phi 5/\phi 2$ of a diameter $\phi 5$ at a position where the open end of the first container 10 and the open end of the second container 50 are in contact with each other to the diameter $\phi 2$ is preferably not less than 0.94 and not more than 0.98. The diameter ϕ5 in the present embodiment is 19.9 mm and the ratio ϕ5/ϕ2 is 0.96.

The inventors of the present invention studies a rod-like cosmetic container that can be held by one hand and that includes a storage container (corresponding to the second container 50 in the present embodiment) in which a cosmetic substance is stored and a brush container (corresponding to the first container 10 in the present embodiment) having a brush attached thereto on a relation between motions of human palms and fingers during handling and the structure of the cosmetic container. As a result, the inventors found that, for example, a right-handed user often held the storage container with four fingers of the left hand except for the pinky and turned the brush container with the thumb, the index finger, and the middle finger of the right hand. The inventors further studied changes in the shapes of the right and left hands and motions thereof during handling. When the user holds the storage container with the four fingers of the left hand, the shape of a space formed spontaneously by the palm and the four fingers is not cylindrical but substantially conical having a diameter increased in the direction of the thumb. Also as for the right hand, the shape of a space formed spontaneously by the three fingers is not cylindrical but substantially conical. It is preferable that the storage container have a profile suited for the substantially conical shape because it conforms to the shape spontaneously formed by the palms and the fingers. From this analysis and as a result of trial and error, the inventors of the present invention found that, when the cosmetic container generally had a conical shape defined as described above and the ratio in the dimension between the storage container and the brush container was within the range of numbers described above, the user could use the cosmetic container effectively and comfortably in the process of grasping the cosmetic container, the process of taking out the applicator from the container, and the process of storing the applicator therein from the ergonomic viewpoint based on the structure of human hands.

A wall thickness d1 (see FIG. 4) of a major part of the external member 12 and a wall thickness d2 (see FIG. 6) of a major part of the external member 52 are defined to be not less than 8% and not more than 9.5% of the diameter ϕ2. The major parts indicate parts of the external member 12 and the external member 52 other than parts near closed ends and open ends thereof. Preferably, the wall thickness d1 is not less than 8% and not more than 9% of the diameter ϕ2 and the wall thickness d2 is not less than 8.5% and not more than 9.5% of the diameter ϕ2. The wall thickness d1 is preferably slightly smaller than the wall thickness d2. In the present embodiment, the wall thickness d1 is 1.75 mm, which is 8.5% of the diameter ϕ2, and the wall thickness d2 is 1.90 mm, which is 9.2% of the diameter ϕ2.

The inventors of the present invention studied the relation between the force applied by the user with the fingers when the user grasps the cosmetic container and the visual effect provided by the cosmetic container to the user. As a result, the inventors found that a slightly larger force was applied to the fingers in a case where the external member 12 and the external member 52 were transparent than in a case where the external member 12 and the external member 52 were opaque, and that this was suitable for handling of the cosmetic container 1. This is attributed to the fact that the transparent member makes the user more conscious of the internal member 14 (54), which is visually recognized through the external member 12 (52). The inventors found that the user applied a suitable force to the external member 12 (52) in the cosmetic container 1 when the wall thickness of the major part of the external member 12 (52) was within the range of numbers described above. Application of a suitable force with the fingers enables the first container 10 and the second container 50 to be engaged or disengaged effectively and comfortably with no failure.

Figure 4:
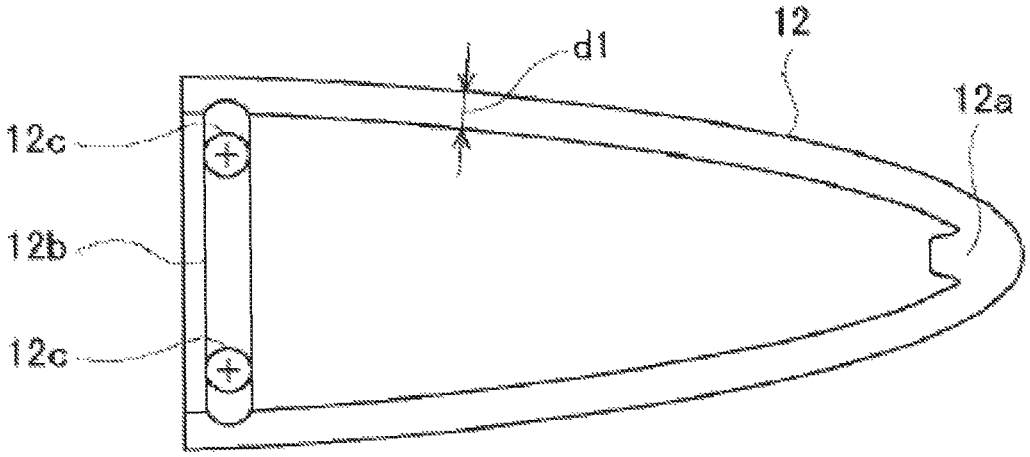
FIG. 4 is a schematic sectional view of an external member of the first container.

As illustrated in FIG. 4, a protrusion 12*a* protruding inward is formed at the closed end of the external member 12 of the first container 10 and a substantially-semicircular concave groove 12*b* is formed on an inner periphery near the open end. Substantially-hemispherical convex portions 12*c* are formed on the concave groove 12*b*. That is, the concave groove 12*b* is raised only at the convex portions 12*c*. At least one convex portion 12*c* is formed. In the present embodiment, one convex portion 12*c* is placed every 90 degrees on the substantially-semicircular groove 12*b*.

Figure 5:
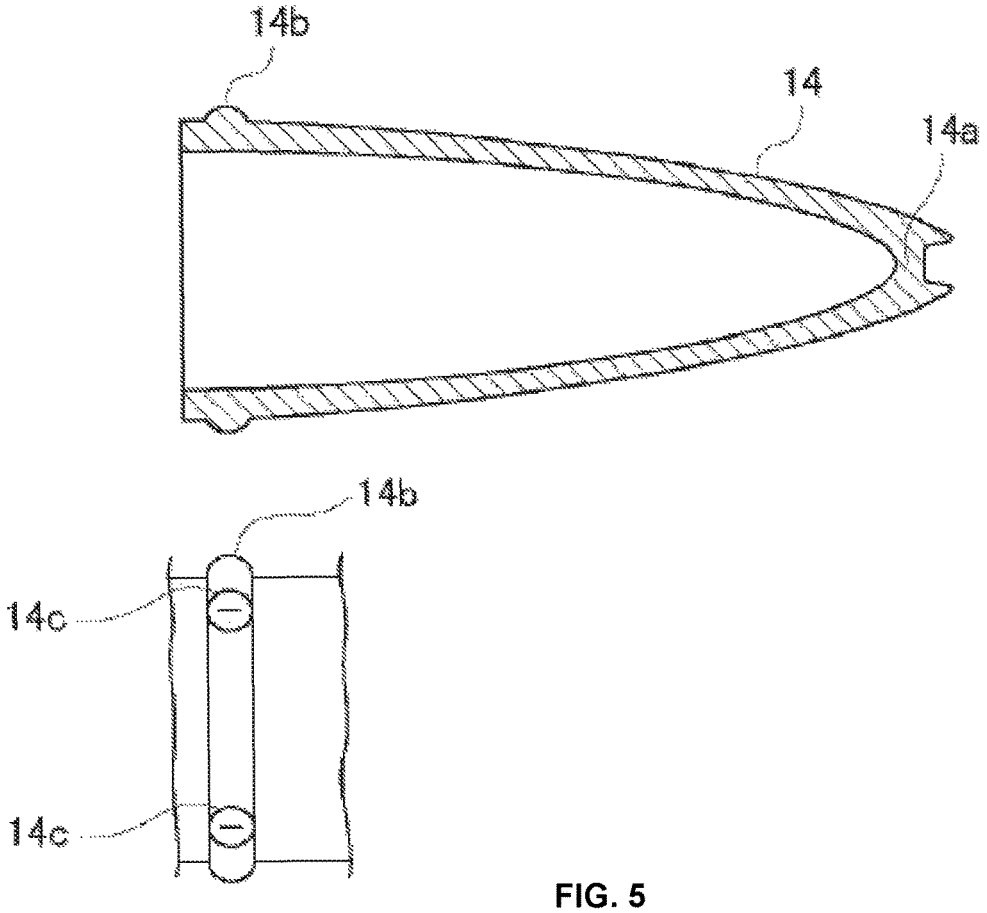
FIG. 5 is a schematic sectional view illustrating an internal member of the first container and a schematic view illustrating a part of an outer periphery of the internal member.

An upper drawing in FIG. 5 is a schematic sectional view of the internal member 14 of the first container 10. A recess 14*a* opened toward outside is provided at the closed end of the internal member 14. The recess 14*a* engages with the protrusion 12*a* when the external member 12 and the internal member 14 engage with each other. A semicircular rib 14*b* is formed on an outer periphery of the internal member 14 near the open end. The rib 14*b* engages with the concave groove 12*b* when the external member 12 and the internal member 14 engage with each other. A lower drawing in FIG. 5 is a schematic enlarged view illustrating a part of the outer periphery of the internal member 14. Substantially-hemispherical concave portions 14*c* are formed on the rib 14*b*. That is, the height of the rib 14*b* is reduced only at the concave portions 14*c*. The concave portions 14*c* are positioned as many as and with the same degrees as the convex portions 12*c* described above and engage with the convex portions 12*c* when the external member 12 and the internal member 14 engage with each other. The circular rib is defined to have a width not less than 1.8% and not more than 2.5% of the entire length L1 of the cosmetic container 1.

Engagement between the concave groove 12*b* and the rib 14*b* prevents the external member 12 and the internal member 14 from being displaced in the length direction of the cosmetic container 1, and engagement between the convex portions 12*c* and the concave portions 14*c* prevents the external member 12 and the internal member 14 from relatively turning.

Figure 6:
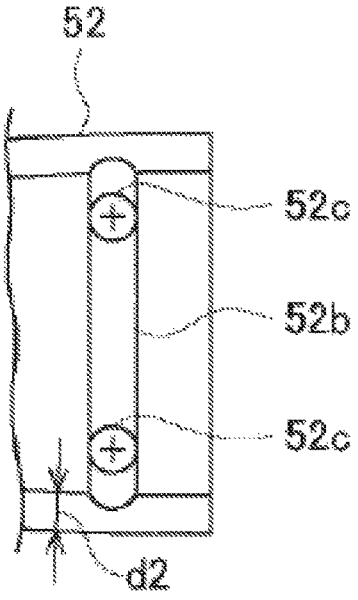
FIG. 6 is a schematic sectional view illustrating an external member of the second container.

As illustrated in FIG. 6, a substantially-semicircular concave groove 52*b* is formed on an inner periphery of the second container 50 near the open end. Substantially-hemispherical protrusions 52*c* are formed on the concave groove 52*b*. That is, the concave groove 52*b* is raised only at the protrusions 52*c*. At least one protrusion 52*c* is formed. In the present embodiment, one protrusion 52*c* is placed every 90 degrees on the substantially-semicircular concave groove 52*b*.

Figure 7:
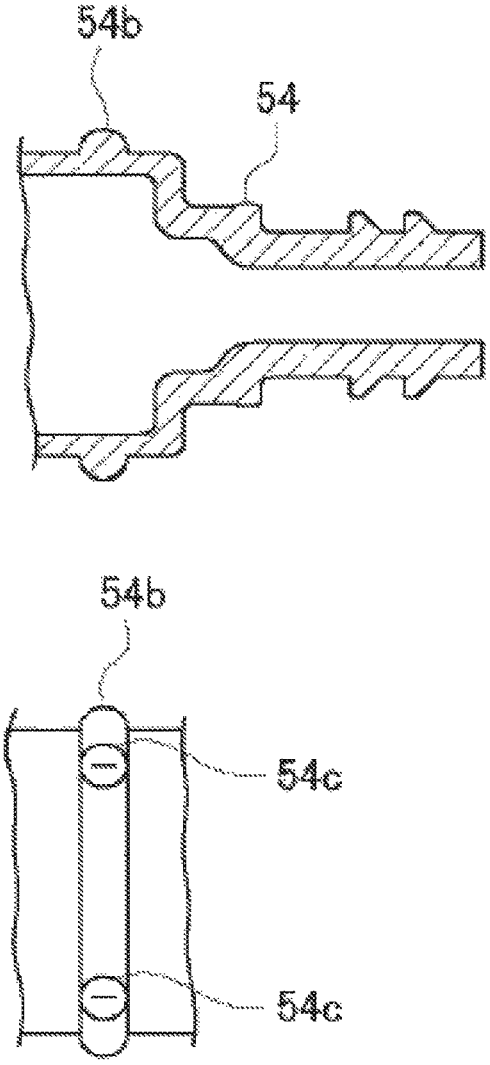
FIG. 7 is a schematic sectional view illustrating an internal member of the second container and a schematic view illustrating a part of an outer periphery of the internal member.

An upper drawing in FIG. 7 is a schematic sectional view illustrating a part of the internal member 54 of the second container 50. A substantially-semicircular rib 54*b* is formed on an outer periphery of the internal member 54 of the second container 50 near the open end. The rib 54*b* engages with the concave groove 52*b* when the external member 52 and the internal member 54 engage with each other. A lower drawing in FIG. 7 is a schematic enlarged view illustrating a part of the outer periphery of the internal member 54. Substantially-hemispherical concave portions 54*c* are formed on the rib 54*b*. That is, the height of the rib 54*b* is reduced only at the concave portions 54*c*. The concave portions 54*c* are positioned as many as and with the same degrees as the protrusions 52*c* described above and engage with the protrusions 52*c* when the external member 52 and the internal member 54 engage with each other. The circular rib is defined to have a width not less than 1.8% and not more than 2.5% of the entire length L1 of the cosmetic container 1.

Engagement between the concave groove 52*b* and the rib 54*b* prevents the external member 52 and the internal member 54 from being displaced in the length direction of the cosmetic container 1, and engagement between the protrusions 52*c* and the concave portions 54*c* prevents the external member 52 and the internal member 54 from relatively turning.

As described above, the configuration for engaging the internal member 14 (54) and the external member 12 (52) is provided near the open end of the first container 10 (the second container 50) and the external member 12 (52) is transparent. Therefore, a structure formed by the rib 14*b* (54*b*) and the concave groove 12*b* (52*b*) comes out as an annular pattern. A structure formed by the protrusions 12*c* (52*c*) and the concave portions 14*c* (52*c*) comes out as dot patterns in an annular pattern. The user can visually recognize these patterns. When the user performs engagement or disengagement of the first container 10 and the second container 50, it is effective that a force is applied to parts near the open ends of the first container 10 and the second container 50 where the diameters are the largest. The configurations for engaging the first container 10 and the second container 50 serve as marks for providing visual recognition of the parts near the open ends, and enable the user to apply the force promptly at appropriate portions.

The cosmetic container of the present invention is not limited to the embodiment described above and can be modified in various manners without departing from the scope of the present invention.

REFERENCE SIGNS LIST

1 cosmetic container
10 first container
12 external member
14 internal member
50 second container
52 external member
54 internal member

The invention claimed is:

1. A cosmetic container that can be held by one hand of a user, the cosmetic container comprising:

a first container that has an applicator provided therein and has a cross-section in a direction perpendicular to a length direction, the cross-section being formed in a substantially circular shape; and a second container that removably engages with the first container, is longer than the first container, has a cross-section in a direction perpendicular to a length direction, the cross-section being formed in a substantially circular shape, and has an application material stored therein, wherein a profile of the cosmetic container formed when the first container and the second container engage with each other is substantially spindle-shaped, the first container is formed to have a length accounting for not less than 30% and not more than 45% of a length of the cosmetic container and the second container is formed to have a length accounting for not less than 55% and not more than 70% thereof, assuming that a middle position in a length direction of the cosmetic container is a first middle position, middle positions in a length between the first middle position and closed ends of the cosmetic container are second middle positions, and middle positions in a length between the second middle positions and the closed ends are third middle positions, a diameter $\phi$2 at the first middle position is a maximum diameter of the cosmetic container, a ratio $\phi$3/$\phi$2 of a diameter $\phi$3 at the second middle positions to the diameter $\phi$2 is not less than 0.85 and not more than 0.90, and a ratio $\phi$4/$\phi$2 of a diameter $\phi$4 at the third middle positions to the diameter $\phi$2 is not less than 0.52 and not more than 0.56, and a ratio $\phi$5/$\phi$2 of a diameter $\phi$5 at a position where an open end of the first container and an open end of the second container are in contact with each other to the diameter $\phi$2 is not less than 0.94 and not more than 0.98, wherein each of the first container and the second container has an internal member and an external member formed in substantially symmetrical shapes, the external members are formed of a transparent material, and a wall thickness of a major part of the external members is not less than 8% and not more than 9.5% of the diameter $\phi$2.

2. The cosmetic container according to claim 1, wherein the first container and the second container are formed to engage with each other with an external thread of one of the containers and an internal thread of the other container being screwed with each other, a circular rib is formed on an outer periphery near an open end of each of the internal members, a circular concave groove is formed on an inner periphery near an open end of each of the external members, at least one concave portion is formed on the rib, a projection as many as the concave portion is formed on the concave groove, engagement between the rib and the concave groove prevents displacement of the internal member and the external member in the length direction of the cosmetic container, and engagement between the concave portion and the projection prevents the internal member and the external member from relatively turning.

* * * * *